US011959278B2

(12) United States Patent
Janczura et al.

(10) Patent No.: US 11,959,278 B2
(45) Date of Patent: Apr. 16, 2024

(54) SUPPORTING BEAM FOR SLAB SYSTEMS, SLAB SYSTEM, AND METHOD FOR THE PRODUCTION THEREOF

(71) Applicant: Pfeifer Holding GmbH & Co. KG, Memmingen (DE)

(72) Inventors: Krzysztof Janczura, Wroclaw (PL); Jerzy Derysz, Warsaw (PL)

(73) Assignee: Pfeifer Holding GmbH & Co. KG, Memmingen (DE)

( * ) Notice: Subject to any disclaimer, the term of this patent is extended or adjusted under 35 U.S.C. 154(b) by 283 days.

(21) Appl. No.: 17/264,249

(22) PCT Filed: Jul. 31, 2019

(86) PCT No.: PCT/EP2019/070609
§ 371 (c)(1),
(2) Date: Jan. 28, 2021

(87) PCT Pub. No.: WO2020/025664
PCT Pub. Date: Feb. 6, 2020

(65) Prior Publication Data

US 2021/0293022 A1 Sep. 23, 2021

(30) Foreign Application Priority Data

Jul. 31, 2018 (DE) ..... 102018212750.6

(51) Int. Cl.

| | |
|---|---|
| ***E04B 5/17*** | (2006.01) |
| ***E04C 3/20*** | (2006.01) |
| ***E04C 3/294*** | (2006.01) |
| ***E04C 5/06*** | (2006.01) |

(52) U.S. Cl.
CPC ..... *E04C 3/294* (2013.01); *E04B 5/17* (2013.01); *E04C 3/20* (2013.01); *E04C 5/0622* (2013.01)

(58) Field of Classification Search
CPC ..... E04B 5/17; E04B 5/29; E04B 5/16; E04B 5/18; E04B 5/19; E04B 5/23; E04B 5/26;
(Continued)

(56) References Cited

U.S. PATENT DOCUMENTS

| | | | | |
|---|---|---|---|---|
| 10,407,910 | B2 * | 9/2019 | Janczura | E04C 3/293 |
| 2004/0182027 | A1 * | 9/2004 | Bonacci | E04B 5/29 52/319 |

(Continued)

FOREIGN PATENT DOCUMENTS

| | | | |
|---|---|---|---|
| CA | 2 996 993 | A1 | 3/2017 |
| CN | 203403602 | A | 1/2014 |

(Continued)

OTHER PUBLICATIONS

International Search Report and Written Opinion dated Oct. 8, 2019 in connection with International Application No. PCT/EP2019/070609, and English translation thereof.

(Continued)

*Primary Examiner* — Jessica L Laux
(74) *Attorney, Agent, or Firm* — Wolf, Greenfield & Sacks, P.C.

(57) ABSTRACT

The invention relates to a supporting beam, in particular of composite design, for slab systems, in particular of composite design, wherein the supporting beam extends in a longitudinal direction and has: a support extending in the longitudinal direction, in particular a steel support, which is formed in at least two pieces and has at least two support parts which each extend in the longitudinal direction.

18 Claims, 4 Drawing Sheets

(58) Field of Classification Search
CPC ..... E04B 5/36; E04B 9/06; E04B 2005/173; E04B 2005/176; E04B 2005/322; E04B 2005/324; E04C 5/0622; E04C 5/0618; E04C 5/0631; E04C 3/294; E04C 3/293; E04C 3/20
See application file for complete search history.

(56) References Cited

U.S. PATENT DOCUMENTS

| | | | |
|---|---|---|---|
| 2008/0282644 | A1 | 11/2008 | Hong et al. |
| 2018/0291626 | A1 | 10/2018 | Janczura et al. |

FOREIGN PATENT DOCUMENTS

| | | | |
|---|---|---|---|
| CN | 108291401 | A | 7/2018 |
| DE | 102 32 377 | A1 | 2/2004 |
| DE | 20 2015 104 628 | U1 | 1/2017 |
| EP | 0 292 449 | B1 | 7/1991 |
| GB | 1 263 406 | A | 2/1972 |
| WO | WO 03/100187 | A1 | 12/2003 |
| WO | WO 2007/066971 | A1 | 6/2007 |
| WO | WO 2009/087321 | A1 | 7/2007 |
| WO | WO 2017/037106 | A1 | 3/2017 |

OTHER PUBLICATIONS

International Preliminary Report on Patentability dated Nov. 5, 2020 in connection with International Application No. PCT/EP2019/070609, and English translation thereof.
Chinese Office Action dated Mar. 23, 2022, in connection with Chinese Application No. 201980050711.0.

* cited by examiner

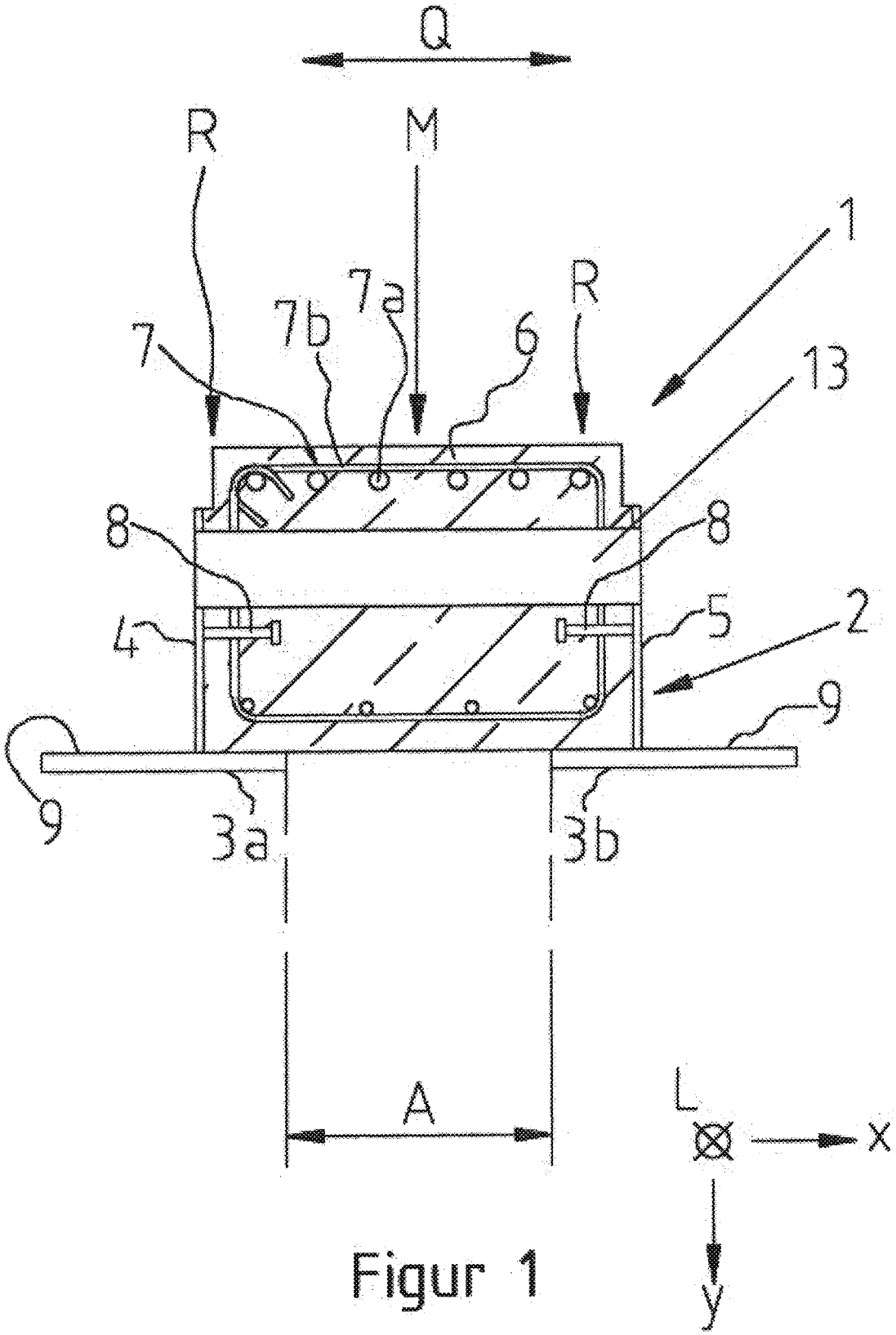
Figur 1

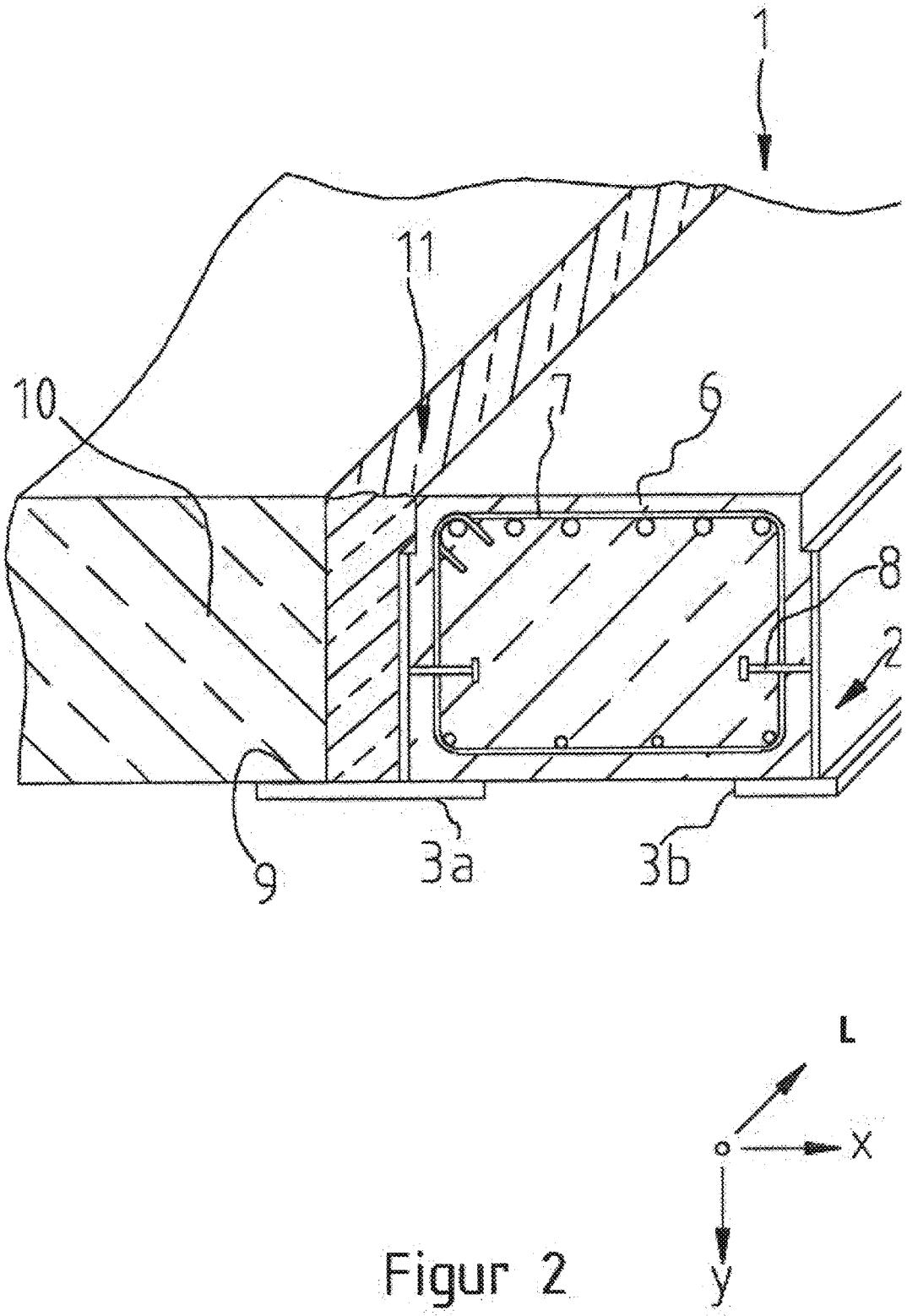
Figur 2

Fig.3a
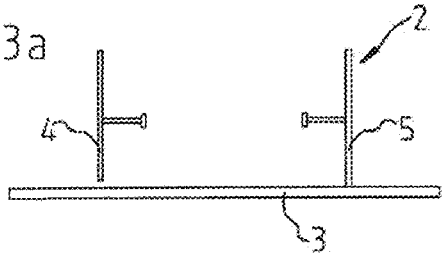
Fig.3b
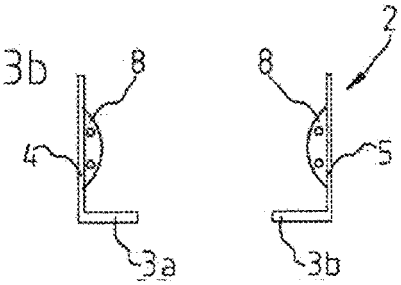
Fig.3c
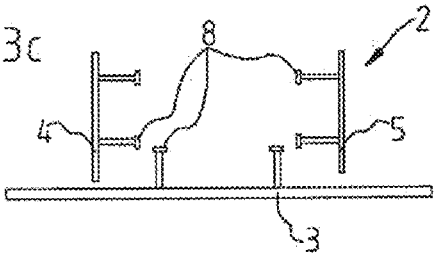
Fig.3d
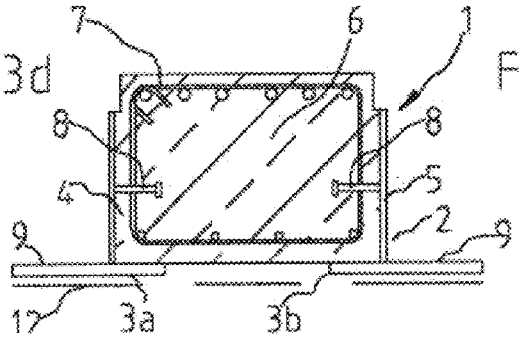
Fig.3e
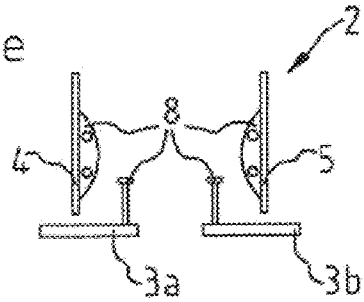
Fig.3f
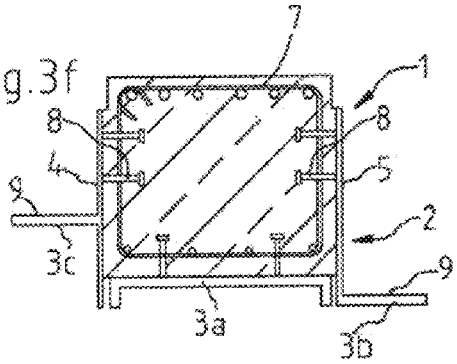
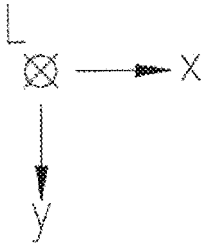

SUPPORTING BEAM FOR SLAB SYSTEMS, SLAB SYSTEM, AND METHOD FOR THE PRODUCTION THEREOF

CROSS-REFERENCE TO RELATED APPLICATIONS

This Application is a national stage filing under 35 U.S.C. § 371 of International Patent Application Serial No. PCT/EP2019/070609, filed Jul. 31, 2019, which claims priority to German application number 10 2018 212 750.6, filed Jul. 31, 2018. The entire contents of these applications are incorporated by reference in their entirety.

TECHNICAL FIELD

The invention relates to a supporting beam for slab systems, as according to the preamble of claim 1. Such supporting beams are often used in the construction industry, in particular as support structures for slabs and secondary joists of reinforced concrete construction or composite construction also with other materials, in particular in the construction of slab systems or floors. The supporting beam may consist of portions of steel cross sections, usually filled with concrete, wherein the concrete is often strengthened by reinforcement in the form of a reinforcement cage.

PRIOR ART

WO 2017/037106 A1, for example, discloses a supporting beam of composite design for slab systems of composite design which consist at least in sections of concrete, having a support, in particular a steel support, which comprises a base plate and at least one, preferably two, web(s) arranged at an angle thereto, preferably perpendicular thereto, characterized in that a space delimited by the web(s) and the base plate is filled at least in sections with concrete which is preferably not in-situ concrete.

The production of such supports can be complex and associated with high costs.

DESCRIPTION OF THE INVENTION

The object of the present invention is therefore to simplify a supporting beam with a simple construction, in particular in terms of the production, composition and/or effect thereof.

This object is achieved by the supporting beam according to claim 1. This supporting beam is intended for slab systems, wherein the supporting beam is preferably of composite design and/or the slab system may be of composite design. In particular, the supporting beam can be understood to be a pre-fabricated composite beam, which as such is capable of bearing a load and comprises, for example, steel and (reinforced) concrete. Such a supporting beam may also form a (further) composite with slab elements or a slab, thereby achieving a homogenous slab structure in the composite construction.

The supporting beam extends in the longitudinal direction and has a support running in the longitudinal direction, which is preferably a steel support. The invention is characterized in that the support is formed in at least two pieces and has at least two support parts which each extend in the longitudinal direction.

The present invention is based on the inventive idea that the support is divided, in particular divided into two pieces, or divided into several pieces. The fact that the support is divided can preferably be seen when viewed in cross section perpendicular to the longitudinal direction. Preferably, there is a gap between the individual support parts along the transverse direction of the supporting beam.

Divided refers in particular to the fact that the support is divided into or formed of a plurality of pieces when viewed in a cross section over the length thereof or in the cross section perpendicular to the longitudinal direction. The division may relate to a division in relation to the extension in the transverse direction, i.e. perpendicular to the longitudinal direction. The transverse direction covers a lateral or horizontal direction (designated the X direction in this case, running from left to right) and a vertical direction (designated the Y direction in this case, running from top to bottom), which extend perpendicular to the longitudinal direction.

A divided or multi-part support is to be understood, in particular, to be a support that is formed of a plurality of pieces. The support parts do not form an integral, continuous support part.

In other words, the support is not continuous. Thus, the support parts in the supporting beam may well be surrounded by concrete or the like, which joins the individual support parts to the supporting beam, wherein as such the support is still to be considered to be formed of a plurality of pieces.

The support parts can therefore be inserted so as to be flush with the slab. In this connection, a support plate and bottom chord plate can additionally be used on the same plane in the vertical direction to achieve a reliable fit and optical uniformity.

It is also conceivable that support parts are held together by an element which also consists of steel and could be considered to be a further support part. Such an element or a plurality of such elements result in the joining, in sections, of support parts, in particular in the longitudinal direction. The support is still formed of a plurality of pieces also in this case.

The two-part or multi-part form of the support refers to the fact that the support is produced from at least two or a plurality of parts/pieces.

The support may also be referred to as the steel cross section of the supporting beam. Preferably, one embodiment of the invention can be described as follows: the cross section at the end is composed of more than one partial cross section or the supporting beam is composed of more than one part to form the end cross section. These parts may be produced separately and only later assembled to form a unit and then appear in a cross section of the supporting beam.

The elements that are part of the support preferably consist of steel. Thus, the support is a steel support. The support described herein is, in particular, a component part usually consisting of sheet steel or rolled steel, which, when the supporting beam is filled with concrete, generally contributes at least in part as formwork for the concrete of the supporting beam. The sheet steel can be smooth, edged and/or welded.

The multi-part form of the support is apparent from the fact that the support comprises at least two support parts which each extend in the longitudinal direction. Preferably, the support parts can be arranged so as to be substantially parallel to one another and at the same position in the longitudinal direction. In other words, the support parts can extend substantially side by side.

The plurality of parts of the support preferably extend side by side and not one behind the other in the longitudinal direction. As a result of the fact that the two support parts extend side by side, the multi-part formation is shown in particular in a cross-sectional view along the transverse direction perpendicular to the longitudinal direction. Thus, the multi-part form of the support can be shown in particular in a cross-sectional view perpendicular to the longitudinal direction.

The multi-part form of the support is apparent in particular in the cross section, i.e. in relation to the transverse direction. Preferably, the support parts extend parallel to one another in the longitudinal direction, such that the support parts are lined up not exclusively in the longitudinal direction. The same also applies to the base plate, if the multi-part form of the support (possibly among other things) is realized as a multi-part form of the base plate, or other parts of the support. Preferably, there is a gap between the individual base plate parts along the transverse direction of the supporting beam. Not only can the base plate be formed of a plurality of parts spaced apart along the transverse direction, but a gap can also be formed between the base plate (consisting of a plurality of base plate parts) and other support parts along the X direction.

Preferably, the at least two support parts are arranged so as to be spaced apart from one another in a transverse direction running perpendicular to the longitudinal direction. In other words, there can therefore be a space between the support parts running in the transverse direction.

Often, a reinforcement cage (reinforcing cage) consisting of stirrups and longitudinal reinforcement is used—as is customary in the construction industry—inside the concrete portion of the supporting beam for strengthening it. In particular, however, the support described herein is not to be understood to be such a reinforcement cage, reinforcing steel or the like. Connecting means are not to be considered supports either.

As a skilled person in the construction industry will know, a "reinforcement cage" or "reinforcing cage" is generally to be understood as reinforcement for concrete components, which facilitates an improved capacity to bear a load and improved absorption of any forces that may occur.

In this respect the reinforcement cage comprises, for example, a plurality of reinforcement bars arranged side by side in the transverse direction of the supporting beam, which in turn extend along the longitudinal direction of the supporting beam and are arranged, for example, one above the other in two rows in the vertical direction. This arrangement of reinforcement bars is surrounded by the stirrups, or the stirrups encompass this longitudinal reinforcement. The stirrups offer transverse reinforcement and are substantially bars that are bent in such a way that they are each substantially self-contained. A plurality of stirrups surrounds the reinforcement bars at regular intervals along the longitudinal direction of the supporting beam. In other words, a stirrup is arranged at recurring intervals in the longitudinal direction. Thus, a cage is formed by the stirrups and longitudinal bars, which facilitates corresponding longitudinal and transverse reinforcement.

Such a reinforcement cage can be used as a slack or loose element between the support parts of the supporting beam and can be cast with concrete to reinforce the supporting beam.

An advantage of the invention is that the support parts can be used for various supporting beams, in particular for supporting beams of different widths or heights, since the spacing between the support parts in the transverse direction can be individually set depending on the desired width or height of the supporting beam. For example, the same support parts can be used for a relatively narrow supporting beam as for a relatively wide supporting beam, and therefore the narrow and wide supporting beams are substantially only different in terms of the spacing between the support parts. In the case of a narrow supporting beam, there might be a relatively small space between the support parts in the transverse direction. This means that pre-fabricated support parts, in particular those of a similar type, can be used universally to form various supporting beams.

A further advantage is that materials for the supports can be saved if instead of a continuous support there are support parts that are spaced apart from one another. This also results in production being more cost-effective.

Preferably, the support has a base plate. The base plate may be formed in at least two pieces or a plurality of pieces and comprises at least two base plate parts which each extend in the longitudinal direction. Dividing the base plate is one possibility of realizing a divided support. This design is efficient and easy to implement. Preferably, a base plate or base plate part is to be understood to be a support part which does not protrude and/or which delimits a region of the supporting beam which is filled with concrete.

The use of elements which connect the base plate parts in sections in the longitudinal direction is conceivable particularly where the base plate is divided. These elements may for example be transverse webs or sheets which connect base plate parts in individual sections (sections in the longitudinal direction) perpendicular to the longitudinal direction, i.e. in the transverse direction.

The supporting beam may have a support comprising at least one, preferably two, web(s) arranged at an angle thereto, preferably perpendicular thereto. The use of webs, which preferably extend from the base plate, allows a stable construction of a support which is capable of bearing a load.

The multi-part form of the support may be formed, for example, by a multi-part form of the base plate (i.e. a space between the base plate parts) and/or by spaces between a web and/or webs relative to one another and/or in relation to the base plate, in particular in the transverse direction.

The supporting beam is preferably a composite beam and comprises concrete at least in sections, wherein the concrete is hardened, in particular during assembly at the construction site, such that it is capable of bearing a load and/or wherein the concrete is not (subsequently added) in-situ concrete. The concrete may, for example, be present as such in the supporting beam prior to the assembly of the supporting beam in the structure. This facilitates a high load-bearing capacity of the beam as well as an efficient assembly process.

Finally, a particularly advantageous embodiment is conceivable wherein two base plate halves are provided, which in the mounted supporting beam are symmetrical to one another in relation to a plane of symmetry along the longitudinal axis. In this case, the left and right base plate halves may be produced from a continuous profile. One embodiment of the multi-part form is the spacing of base plate parts in the transverse direction. The base plate parts may, for example, be spaced apart from one another in the vertical or horizontal direction, in particular when viewed in a cross-sectional view. This allows the advantages according to the invention to be easily achieved. The base plate parts may also be connected in sections (in particular to simplify production). Individual sections in the longitudinal direction can connect the base plate parts in the transverse direction, for example.

In a preferred embodiment, the support parts are symmetrical to one another in relation to the longitudinal axis of the supporting beam. In such an embodiment, the two support parts may be produced from a continuous profile, which is inexpensive. The continuous profile may be cut in the longitudinal direction and then arranged side by side, such that the support parts of the supporting beam are provided as a result.

Preferably, the support parts are arranged at the edge regions when viewed in a transverse direction running perpendicular to the longitudinal direction, and/or the support parts are spaced apart from one another in the central region when viewed in a transverse direction running perpendicular to the longitudinal direction. As a consequence, the supporting beam is less complex to produce. In this way, the stability of the supporting beam in the edge regions can also be maintained, with a compromise being acceptable in terms of the load-bearing capacity in the central region of the supporting beam.

The supporting beam may comprise a reinforcement cage which preferably consists of reinforcing steel. The reinforcement cage may comprise at least one longitudinal bar and/or at least one stirrup. The concrete may surround the reinforcing steel of the reinforcement cage at least in sections, preferably completely, wherein the concrete hardens even during assembly. As a result, the stability of the supporting beam and its capacity to bear a load can be increased.

Preferably, connecting means attached to the support extend through interstices in the reinforcement cage in the transverse direction. Such connecting means can contribute to a frictional connection between the support and the concrete, which increases the capacity to bear a load.

Preferably, the base plate and/or a web or a plurality of webs comprises one or more protruding elements or protrusions extending perpendicular to the longitudinal direction, which serve to support further components. Such protruding elements project from the supporting beam and can support component parts such as finished parts or semi-finished parts. The protruding element may also be referred to as a protrusion or a slab support/bearing, which protrudes from the rest of the supporting beam, in particular in a transverse direction, more particularly in the X direction.

The base plate, in particular on the underside thereof which faces away from the supporting beam, and/or a protrusion preferably a barrier which serves to protect against heat and/or flames. Preferably, this protective barrier can take the form of a film-forming coating. This will prevent the support from losing its strength when heat forms, in particular by way of fire, which would result in the supporting beam becoming unstable.

The invention is further realized by a method for producing a supporting beam which extends in the longitudinal direction. The supporting beam is produced with a desired extension in a transverse direction running perpendicular to the longitudinal direction, wherein preferably the supporting beam according to the invention is used for slab systems of composite design. The steps include providing at least two support parts, in particular steel support parts, determining the position of the support parts relative to one another in relation to the transverse direction according to the desired extension of the supporting beam in the transverse direction, and arranging the support parts according to the determined position and in such a way that the support parts extend in the longitudinal direction.

When producing the supporting beam, the multi-part, preferably two-part, form of the support is advantageous. Various arrangement possibilities open up, for example, such that production can be optimized in terms of the time involved and the procedure.

Preferably, a space between the support parts in the transverse direction will be determined when the position of the supports is determined.

Optionally, a reinforcement cage is provided, and the support parts are arranged around the reinforcement cage when they are arranged according to the determined position, wherein the reinforcement cage is preferably in its final form during this process. By arranging and producing a supporting beam with a reinforcement cage in this manner, significant simplification and time-saving can be achieved. A particular advantage is revealed when a reinforcement cage is used at the same time, since then the parts of the support with the protruding connecting means such as pins, protrusions or block shear connectors, which are attached on the side facing the concrete, can be arranged around the reinforcement cage, in particular they can be threaded through the reinforcement cage from the side. This makes it possible to use the reinforcement cage in its finished state during assembly and the support parts can be joined together around the reinforcement cage as formwork for the supporting beam.

Preferably, the provision of at least two support parts includes a continuous support profile being divided into at least two parts in the longitudinal direction.

Preferably, the support, in particular steel support, which extends in the longitudinal direction, is formed with a rise, which can also be understood as a cant. In particular, the at least one web(s) may have a rise. A "rise" is to be understood here to be an arched, curved form of the support or part extending in the longitudinal direction, wherein the "arch" extends against the (future) load direction along the longitudinal direction of the support. This creates a "banana-shaped" extension of the support along the longitudinal direction, which counteracts or can compensate for the load as a result of the concrete and, for example, the slab weight in the vertical direction of the supporting beam. Such a rise has a "rising height" or "pitch" and describes a measurement that indicates the distance between the springing line and the apex of the arch of such a curvature. In other words, the support parts (or at least one support part, preferably at least the webs) can have a precamber. This means that the support is produced with a curvature which counteracts a potential deflection in the loaded state and thus compensates for a future deflection. In other words, the "cant" (rise) corresponds to a later deflection of the supporting beam.

As a consequence, a homogenous and flush slab design can be achieved. These supporting beams produced with a so-called cant have advantages for the discernible small deflection in the finished structure since the deflection when mounting the slab elements and the cant almost cancel each other out.

According to the invention, the intended use of the supporting beam according to the invention is in a slab system of composite design, wherein the supporting beam is used for supporting at least one semi-finished part or finished part or in-situ concrete part or component part made from other materials.

Furthermore, according to the invention a slab system of composite design is provided, wherein the slab system comprises at least one beam as according to the invention, at least one component part, semi-finished part or finished part supported on the at least one supporting beam, and an in-situ concrete layer provided at least in the connecting region between the at least one supporting beam and the component part, semi-finished part and/or finished part. Using the supporting beam in the slab system can ensure a quick, on-site assembly.

According to the invention, a method for producing a slab system of composite design is also provided, which method has the following steps: supporting a supporting beam as according to the invention on bearings, supporting at least one component part, semi-finished part or finished part on the at least one supporting beam, and providing connecting means in the connecting region between the at least one supporting beam and the component part, semi-finished part or finished part.

Optionally, the method may also include the step of providing an in-situ concrete layer at least in the connecting region between the at least one supporting beam and the component part, semi-finished part and/or finished part. The gaps between the parts can be grouted or filled with a grouting mortar or concrete.

BRIEF DESCRIPTION OF THE DRAWINGS

FIG. 1 shows a supporting beam according to the invention in a cross-sectional view perpendicular to the longitudinal direction of the supporting beam.

FIG. 2 shows a perspective view of a supporting beam according to the invention.

DETAILED DESCRIPTION OF PREFERRED EMBODIMENTS

Figure 3G:
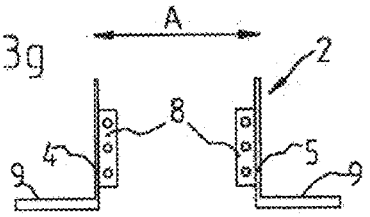
FIG. 3(*a*) to 3(*j*) show various embodiments of a supporting beam according to the invention.

In the following, preferred embodiments of the present invention will be described in detail with reference to the accompanying drawings.

FIG. 1 shows a supporting beam 1 according to the invention in a cross-sectional view perpendicular to the longitudinal direction L of the supporting beam. The supporting beam 1 is of a composite construction, namely a composite of a support 2 and concrete 6. This supporting beam 1 is intended for a slab system (not shown) which may be of composite design. The supporting beam 1 extends in the longitudinal direction L vertically into the drawing plane. The support 2, which is preferably a steel support, is formed in two pieces, wherein the two pieces, i.e. the two support parts, each extend in the longitudinal direction L and run substantially parallel to one another.

FIG. 1 shows a base plate 3 which is formed in two pieces and comprises two base plate parts 3*a* and 3*b*. These run side by side and each extend in the longitudinal direction L. The support 2 has two webs 4, 5, which extend side by side and in this embodiment parallel to one another in the longitudinal direction L. The two webs 4, 5 are arranged so as to be perpendicular to the base plate 3. To be more specific, the web 4 is arranged so as to be perpendicular to the base plate part 3*a*, and the web 5 is arranged so as to be perpendicular to the base plate part 3*b*.

The supporting beam 1 has concrete 6, which is not in-situ concrete; instead, it is hardened prior to assembly such that it is capable of bearing a load. The concrete 6 is only not present in the region in which lateral reinforcing steel can be inserted and which is designated the penetration tube 13. In a sectional view as in FIG. 1, the tube 13 is shown through the concrete 6.

The support parts in the embodiment shown in FIG. 1 are to be understood to be the base plate part 3*a* and the web on the one hand, and the base plate part 3*b* and the web 5 on the other. There is a space A between the two base plate parts 3*a* and 3*b* in the transverse direction Q. In the embodiment shown in FIG. 1, the spacing running in the transverse direction Q is spacing in the X direction. The base plate parts 3*a* and 3*b* are therefore arranged so as to be spaced apart from one another in the X direction.

The two support parts and the two base plate parts 3*a* and 3*b* as well as the webs 4, 5 are formed so as to be symmetrical to one another in relation to the longitudinal direction L, in particular the longitudinal axis L of the supporting beam 1. In other words, one half of the support 1, viewed in the transverse direction Q results from a reflection of the other half of the support 1 on a plane extending through the longitudinal axis of the supporting beam and in the Y direction.

The two support parts 3*a*, 4 on the one hand and 3*b*, 5 on the other are arranged in the edge regions R, when viewed in the transverse direction. The space A between the two support parts lies in the central region M of the supporting beam 1 in the embodiment shown in FIG. 1.

The supporting beam 1 comprises a reinforcement cage 7 which in turn preferably comprises longitudinal bars 7*a* and stirrups 7*b* made of reinforcing steel. In this embodiment, the concrete 6 completely surrounds the reinforcement cage 7 made of reinforcing steel, i.e. the longitudinal reinforcement 7*a* and the stirrups 7*b*.

The supporting beam 1 may comprise connecting means 8 which improve the connection between the support 2 and the concrete 6. The connecting means 8 are attached to the support 2 and extend through interstices in the reinforcement cage 7 in the transverse direction. In this way, a good load-bearing capacity can be achieved.

In the embodiment shown in FIG. 1, protruding elements or protrusions 9 extend from the base plate 3 or the base plate parts 3*a*, 3*b*. The protruding elements 9 are arranged on a base plate part 3*a*, 3*b* and extend in the X direction.

The base plate 3 may be provided integrally with the protruding elements 9. In the embodiment shown in FIG. 1, a base plate part 3*a* is formed integrally with a protruding element 9, and a further base plate part 3*b* is formed integrally with a protruding element 9.

FIG. 2 shows a perspective view of the supporting beam 1 according to the invention in combination with a further component 10. The supporting beam 1 extends in the longitudinal direction L and comprises a reinforcement cage 7. In the embodiment shown in FIG. 2 (and the rest of the Figures), neither the support nor the webs 4, 5 have a rise. The support 2 is formed in two pieces, such that two base plate parts 3*a* and 3*b* are formed. The base plate part 3*a* is integrally connected to the protruding element 9. The component 10, which forms the slab system, rests against the protruding element 9. A gap is formed between the component 10 and the supporting beam 2, which is grouted or filled with in-situ concrete 11 or grout/infill concrete.

FIG. 2 therefore shows a slab system of composite design as according to the invention, which in addition to the supporting beam 1 comprises a component part, a semi-finished part or a finished part 10, wherein an in-situ concrete layer 11 is filled in between. Thus, the supporting beam 1 is used in a slab system of composite design, wherein the supporting beam 1 supports the semi-finished part, finished part 10 or even an in-situ concrete part 11.

Figure 3H:
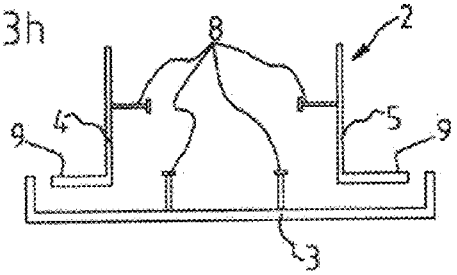
Figure 3I:
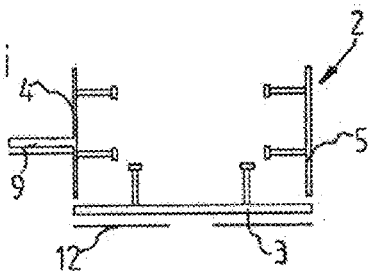
Figure 3J:
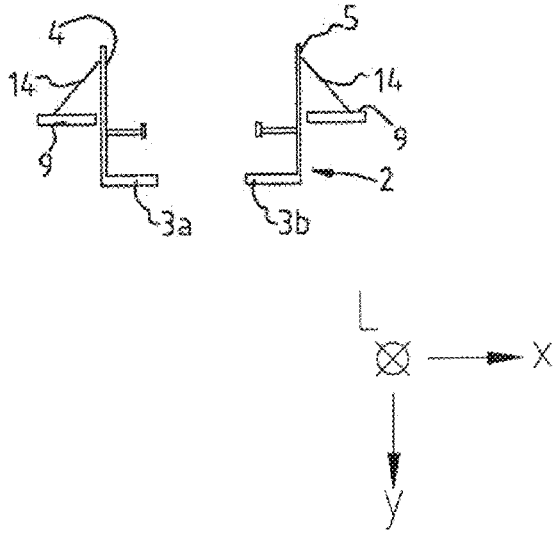

FIG. 3 shows various embodiments of the supporting beam of the present invention in cross section, wherein for the most part the support 2 is substantially shown as such. Only FIGS. 3(*d*) and 3(*f*) show a supporting beam 1 with the carrier 2, reinforcement cage 7 and concrete 6.

FIG. 3(*a*) shows an embodiment comprising an integral base plate 3. This base plate 3 is integrally formed with the web 5. The web 4, which is opposite the web 5, is spaced apart from the base plate 3 in the Y direction. Consequently, the support 2 in the embodiment of FIG. 3(*a*) is formed in two pieces: the support 2 comprises a first support part 4 (the web 4) and a second support part formed by the base plate 3 and the web 5. The space between the base plate and the web 4 results in a multi-part form of the support 2. Other arrangements of the web 4 with respect to the base plate 3/web 5 in the transverse direction (X direction) allow supporting beams of different widths to be formed.

In the embodiment of the support 2 that is shown in FIG. 3(*b*), the base plate is divided into two base plate parts 3*a* and 3*b*. The base plate parts are integrally connected to a web 4, 5 respectively. As a consequence, the support 2 according to the embodiment in FIG. 3(*b*) is formed in two pieces; that is to say that the base plate is formed in a plurality of pieces. The elements 8 on the webs 4 and 5 constitute connecting means, such as moon-shaped sheets with holes.

In the embodiment shown in FIG. 3(*c*), the base plate 3 is in one piece, while the webs 4, 5 are each arranged so as to be spaced apart from the base plate 3. Thus, the embodiment in FIG. 3(*c*) can be considered to be a multi-part form, or more specifically a three-part form, of the support, wherein the support comprises a first part consisting of the web 5, a second part consisting of the web 4, and a third part consisting of the base plate 3. Connecting means 8 are provided on each of the webs 4, 5 and the base plate 3.

FIG. 3(*d*) shows an embodiment with a two-piece base plate, which comprises the base plate parts 3*a* and 3*b*. In addition, a protective barrier 12 is provided on the underside of the base plate 3*a*, 3*b* and the protruding elements 9, which barrier is resistant to heat and/or fire. Connecting means 8 are shown also in this embodiment. A reinforcement cage 7 is also provided. This Figure also shows the concrete 6, i.e. the complete supporting beam 1, and not just substantially the support 2.

In the embodiment in FIG. 3(*e*), the base plate is formed in two parts by the base plate parts 3*a* and 3*b*. Moreover, the webs 4, 5 are each arranged so as to be spaced apart from the base plate parts. The embodiment in FIG. 3(*e*) can therefore be considered to be a four-piece support 2. Various connecting means 8 are arranged in the interior of the supporting beam 2. Different arrangements of the webs 4 and 5 in the X direction or transverse direction Q with respect to the base plate parts 3*a* and 3*b* result in supporting beams of different widths.

The embodiment in FIG. 3(*f*) shows a supporting beam 1 having a reinforcement cage 7, concrete 6 and a three-piece support 2 which comprises a first support part consisting of the protruding element 9, the base plate part 3*c* and the web 4, a second support part consisting of the base plate part 3*a*, and a third support part consisting of the web 5, the base plate part 3*b* and the protruding element 9. The distinctive features of this embodiment include the third base plate part 3*c*, which is arranged higher in order to support a slab component (not shown) with a smaller thickness (extension in the Y direction) on the protrusion 9.

In this embodiment, as well as in other embodiments, two protruding elements 9 may be arranged at different heights, i.e. at different positions in the Y direction, for supporting slab plates protruding towards opposite sides of the supporting beam 1. However, it is also conceivable that protruding elements 9 are arranged at the same Y height.

The embodiment in FIG. 3(*g*) shows a support 2 consisting of two support parts, wherein one support part consists of a protruding element 9 as well as the web 4, and the other support part consists of a protruding element 9 and the web 5. In this embodiment, the base plate 3 is provided without an inward extension toward the concrete. The protrusion 9 forms the lower end of the support 2 as base plate 3.

In the embodiment shown in FIG. 3(*h*), there is a space between a base plate 3 and the webs 4, 5. The space between the base plate 3 and the protrusions 9 provides particularly good fire protection in the event of flames from below. This embodiment can be considered to be a three-part form since the support consists of three pieces, namely the web 4, the web 5 and the base plate 3. Connecting means 8 are provided on the webs as well as on the base plate 3.

In the embodiment in FIG. 3(*i*), a three-part form of the support is shown: the web 4 together with the protruding element 9 constitutes one part, the base plate 3 constitutes a further support part, and the web 5 constitutes a third support part. Adjustments to the width of the supporting beam 1 are possible by moving the webs 4 and 5. The support parts each comprise connecting means 8. The protective barrier 12 is provided on the underside of the base plate 3 and on the underside of the protruding element 9. The protrusion 9 is elevated, i.e. it is offset in the Y direction with respect to the base plate 3.

In the embodiment in FIG. 3(*j*), a four-piece support is shown, wherein the support comprises a first part consisting of the base plate 3*a* and the web 4, a second part consisting of the protruding element 9 on the left-hand side, a third support part consisting of the base plate part 3*b* and the web 5, and a fourth support part consisting of the protruding element 9 on the right-hand side. The protruding elements 9 may in this case be connected to the respective web 4, 5 by way of connecting elements 14 such as tension plates, sheet metal triangles or tension rods. Despite this connection, there is still a multi-part form of the connected support parts, which is particularly apparent in a cross section elsewhere (in the longitudinal direction L). It is therefore easy to achieve different heights of the protruding element 9.

The supporting beam 1 according to the invention can be produced as follows: when producing the supporting beam 1 extending in the longitudinal direction L, the following steps are taken to achieve a desired extension in the X or Y direction, i.e. in a transverse direction running perpendicular to the longitudinal direction, wherein preferably the supporting beam 1 is produced as according to the invention. First, two or more support parts are provided, such as a first part consisting of the protruding element 9, the base plate part 3*a* and the web 4, as shown in FIG. 1, and a second support part consisting of the protruding element 9, the base plate part 3*b* and the web 5.

The position of the two support parts relative to one another in relation to the transverse direction Q in this case the X direction, is determined by the fact that a desired extension of the supporting beam 1 in the X direction is to be obtained. The first and second support parts 1 are arranged at a considerable distance A from one another if the supporting beam 1 is to have a wide extension in the X direction. However, the distance A will be smaller if the supporting beam 1 is to have a smaller extension in the X direction. The support parts are then arranged in accordance with the determined position and the corresponding spacing in such a way that the support parts extend in the longitudinal direction L. As shown in FIG. 1, the support parts then extend parallel to one another and side by side in the longitudinal direction L.

The reinforcement cage 7 is produced in a previous work step from longitudinal bars 7*a* and stirrups 7*b* of reinforcing steel. The support parts are arranged around the reinforcement cage 7 in accordance with the determined position. The connecting means 8 attached to the support parts can for example be threaded through the reinforcement cage 7 when the support parts are arranged in accordance with the determined position. In particular, the support parts are pushed laterally, i.e. in the X direction, towards the reinforcement cage 7, and the connecting means 8 project into the reinforcement cage 7. In this case, the reinforcement cage 7 may already be in its final form. Thus, it is not necessary to laboriously insert the reinforcement cage 7 into the already assembled support 2 in individual parts; rather, as a result of arranging the individual support parts in and around the reinforcement cage 7, the support 2 is integrated in the supporting beam 2.

The two symmetrical support parts in the embodiment in FIG. 1 can be obtained by a continuous support part profile being divided into two parts in the longitudinal direction. The two parts are arranged side by side, and in the transverse direction Q in accordance with the determined position.

Once the supporting beam 1 consisting of the support 2, reinforcement cage 7 and concrete 6 has hardened, it can be transported to the construction site and used there for producing a slab system. To this end, the supporting beam 1, as shown in FIG. 2, is supported on bearings (not shown) and a component part, a semi-finished part or finished part 10 is subsequently supported on the supporting beam 1. Connecting means are provided in the connecting region between the supporting beam 1 and the finished part/component part 10. Furthermore, an in-situ concrete layer 11 may be provided at least in the connecting region between the supporting beam 1 and the component 10.

In the different embodiments described above, various combinations and designs are shown which relate to the support parts, protruding elements or protrusions, protective barriers, connecting means, reinforcement cages etc. The embodiments that have been set out in detail are of course only given as examples and several further combinations and designs are also conceivable.

The following points also describe the present invention:

1. A supporting beam (1), in particular of composite design, for slab systems, in particular of composite design, the supporting beam extending in the longitudinal direction (L) and having:

a support (2) extending in the longitudinal direction (L), in particular a steel support, characterized in that the support (2) is formed in at least two pieces and has at least two support parts which each extend in the longitudinal direction (L).

2. The supporting beam according to point 1, wherein the support (2) has a base plate (3) which is preferably formed in two pieces and has at least two base plate parts (3*a*, 3*b*) which each extend in the longitudinal direction (L).
3. The supporting beam according to point 1 or 2, wherein the support (2) comprises at least one, preferably two, web(s) (4, 5) arranged at an angle thereto, preferably perpendicular thereto, which are preferably arranged so as to be spaced apart from the base plate.
4. The supporting beam according to one of the preceding points, comprising concrete (6) at least in sections, which is preferably hardened during assembly at the construction site so as to be capable of bearing a load and/or which is preferably not in-situ concrete (11).
5. The supporting beam according to one of the preceding points, wherein the support parts (2) are arranged so as to be spaced apart from one another in a transverse direction (Q) running perpendicular to the longitudinal direction.
6. The supporting beam according to the preceding points 2 and 5, wherein the base plate parts (3*a*, 3*b*) are arranged so as to be spaced apart from one another in the transverse direction.
7. The supporting beam according to one of the preceding points, wherein the support parts are symmetrical to one another in relation to the longitudinal axis (L) of the supporting beam.
8. The supporting beam according to one of the preceding points, wherein the support parts are arranged at the edge regions (R) of the supporting beam, when viewed in a transverse direction running perpendicular to the longitudinal direction, and/or are spaced apart from one another in the central region (M) of the supporting beam, when viewed in a transverse direction (Q) running perpendicular to the longitudinal direction.
9. The supporting beam according to one of the preceding points, wherein the supporting beam comprises a reinforcement cage (7), which preferably consists of reinforcing steel and/or longitudinal bars (7*a*) and stirrups (7*b*), wherein it is further preferable for concrete (6) to surround the reinforcement cage (7) at least in sections, preferably completely.
10. The supporting beam according to point 9, wherein connecting means (8) attached to the support extend through interstices in the reinforcement cage (7) in a transverse direction (Q) running perpendicular to the longitudinal direction.
11. The supporting beam according to one of the preceding points, wherein the support preferably has on the base plate (3) and/or on the web or webs (4, 5) one or more protrusions (9) in a transverse direction running perpendicular to the longitudinal direction, for supporting one or more components.
12. The supporting beam according to one of the preceding points 2 to 11, preferably having a protective barrier (12) against heat and/or flames, preferably in the form of a film-forming coating, on the underside of the base plate (3) or of the protrusion(s).
13. A method for producing a supporting beam (1) extending in the longitudinal direction (L) and having a desired extension in a transverse direction running perpendicular to the longitudinal direction, preferably the supporting beam according to one of the preceding points, for slab systems of composite design, with the following steps:

providing at least two support parts, in particular steel support parts, determining the position of the support parts relative to one another in relation to the transverse direction according to the desired extension of the supporting beam (2) in the transverse direction, arranging the support parts according to the determined position and in such a way that the support parts extend in the longitudinal direction.

14. The method according to point 13, wherein when the position of the support parts is determined a space (A) between the support parts in the transverse direction is determined.
15. The method according to point 13 or 14, wherein a reinforcement cage (7) is also provided and the support parts are arranged around the reinforcement cage (7) when they are arranged according to the determined position, wherein the reinforcement cage is preferably in its final form during this process.
16. The method according to one of the preceding points 13 to 15, wherein the provision of at least two support parts covers a continuous support part profile being divided into at least two parts in the longitudinal direction (L).

17. Use of the supporting beam (1) according to one of the preceding points 1 to 12 in a slab system of composite design, wherein the supporting beam (1) is used to support at least one component part, semi-finished part, finished part (10) or in-situ concrete part (11) or component part made from other materials.

18. A slab system of composite design, comprising:

at least one supporting beam (1) according to one of the preceding points 1 to 12, at least one component part (10), semi-finished part or finished part, which is supported on the at least one supporting beam (1), and an in-situ concrete part (11), which is provided at least in the connecting region between the at least one supporting beam (1) and the component part (10), semi-finished part or finished part.

19. A method for producing a slab system (100) of composite design, with the steps of:

supporting at least one supporting beam (1) according to one of points 1 to 12 on bearings, supporting at least one component part, semi-finished part or finished part (10) on the at least one supporting beam (1), providing connecting means in the connecting region between the at least one supporting beam (1) and the component part, semi-finished part or finished part (10).

20. The method for producing a slab system (100) according to point 19, with the step of:

providing an in-situ concrete layer (11) at least in the connecting region between the at least one supporting beam (1) and the component part, semi-finished part or finished part.

REFERENCE NUMBERS

1 Supporting beam
2 Support
3 Base plate
3*a*, 3*b*, 3*c* Base plate parts
4, 5 Web
6 Concrete
7 Reinforcement cage
7*a* Longitudinal reinforcement
7*b* Stirrup
8 Connecting means
9 Protruding element/protrusion or slab support/bearing
10 Component part, finished part, semi-finished part
11 In-situ concrete
12 Protective barrier
13 Penetration tube
14 Connecting means
L Longitudinal direction
Q Transverse direction
M Central region
R Edge region
A Space

The invention claimed is:

1. A supporting beam of composite design, for slab systems of composite design, the supporting beam extending in a longitudinal direction, the supporting beam comprising:

a steel support consisting of steel, which extends in the longitudinal direction, the steel support being formed in at least two pieces and having at least two steel support parts which each extend in the longitudinal direction, the steel support including a top end and a bottom end, the steel support comprising a base plate at the bottom end thereof, the base plate including at least two base plate parts which each extend in the longitudinal direction, the base plate parts being arranged so as to be spaced apart from one another in a transverse direction, the steel support comprising a first web and a second web arranged at an angle to the base plate, the first and second webs being spaced apart from each other in the transverse direction, each of the first and second webs including an inner surface and an outer surface, the inner surfaces facing inwardly toward each other in the transverse direction, the outer surfaces facing outwardly relative to the inner surfaces in the transverse direction, and the steel support including one or more protrusions protruding outwardly relative to the outer surfaces of the first and second webs only at the baseplate in the transverse direction running perpendicular to the longitudinal direction, the one or more protrusions configured to support one or more components thereon, the transverse direction running horizontally when one or more components are supported thereon.

2. The supporting beam according to claim 1, comprising concrete at least in sections, which is hardened during assembly at the construction site so as to be capable of bearing a load or which is not in-situ concrete.

3. The supporting beam according to claim 1, wherein the steel support parts are arranged so as to be spaced apart from one another in a transverse direction running perpendicular to the longitudinal direction.

4. The supporting beam according to claim 1, wherein the steel support parts are symmetrical to one another in relation to the longitudinal axis of the supporting beam.

5. The supporting beam according to claim 1, wherein the steel support parts are arranged at edge regions of the supporting beam, when viewed in a transverse direction running perpendicular to the longitudinal direction, or are spaced apart from one another in a central region of the supporting beam, when viewed in a transverse direction running perpendicular to the longitudinal direction.

6. The supporting beam according to claim 1, further comprising a reinforcement cage, which consists of reinforcing steel and/or longitudinal bars and stirrups, wherein concrete surrounds the reinforcement cage at least in sections.

7. The supporting beam according to claim 1, further comprising a protective barrier against heat or flames on the underside of the base plate or the one or more protrusions.

8. The supporting beam according to claim 1, wherein the first and second webs are arranged at an angle perpendicular to the support.

9. The supporting beam according to claim 8, wherein the two webs are arranged so as to be spaced apart from the base plate.

10. A supporting beam of composite design, for slab systems of composite design, the supporting beam extending in a longitudinal direction, the supporting beam comprising:

a steel support consisting of steel, which extends in the longitudinal direction, the steel support being formed in at least two pieces and having at least two steel support parts which each extend in the longitudinal direction, the steel support including a top end and a bottom end, the steel support comprising a base plate at the bottom end thereof, the base plate including at least two base plate parts which each extend in the longitudinal direction, the base plate parts being arranged so as to be spaced apart from one another in a transverse direction, the steel support comprising a first web and a second web arranged at an angle to the base plate, the first and second webs being spaced apart from each other in the transverse direction, each of the first and second webs including an inner surface and an outer surface, the inner surfaces facing inwardly toward each other in the transverse direction, the outer surfaces facing outwardly relative to the inner surfaces in the transverse direction, the steel support including one or more protrusions protruding outwardly relative to the outer surfaces of the first and second webs only at the baseplate in the transverse direction running perpendicular to the longitudinal direction, the one or more protrusions configured to support one or more components thereon, the transverse direction running horizontally when one or more components are supported thereon, a reinforcement cage, which consists of reinforcing steel and/or longitudinal bars and stirrups, wherein concrete surrounds the reinforcement cage at least in sections, and connectors attached to the steel support which extend through interstices in the reinforcement cage in a transverse direction running perpendicular to the longitudinal direction.

11. A method for producing a supporting beam extending in the longitudinal direction according to claim 1, having a desired extension in a transverse direction running perpendicular to the longitudinal direction, for slab systems of composite design, the method comprising acts of:

providing at least two steel support parts, determining the position of the steel support parts relative to one another in relation to the transverse direction according to the desired extension of the supporting beam in the transverse direction, and arranging the steel support parts according to the determined position and in such a way that the steel support parts extend in the longitudinal direction.

12. The method according to claim 11, wherein when the position of the steel support parts is determined, a space between the steel support parts in the transverse direction is determined.

13. The method according to claim 11, further comprising providing a reinforcement cage and arranging the support parts around the reinforcement cage when the support parts are arranged according to the determined position, wherein the reinforcement cage is in its final form during this process.

14. The method according to claim 11, wherein the provision of at least two steel support parts covers a continuous steel support part profile being divided into at least two parts in the longitudinal direction.

15. Use of the supporting beam according to claim 1, in a slab system of composite design, wherein the supporting beam is used to support at least one component part, semi-finished part, finished part or in-situ concrete part or component part made from other materials on the one or more protrusions.

16. A slab system of composite design, comprising:

at least one supporting beam according to claim 1, at least one component part, semi-finished part or finished part, which is supported on the one or more protrusions, and an in-situ concrete layer, which is provided at least in a connecting region between the at least one supporting beam and the component part, semi-finished part and/or finished part.

17. A method for producing a slab system of composite design, the method comprising acts of:

supporting at least one supporting beam according to claim 1 on bearings, supporting at least one component part, semi-finished part or finished part on the one or more protrusions, providing connectors in a connecting region between the at least one supporting beam and the component part, semi-finished part or finished part.

18. The method according to claim 17, further comprising an act of:

providing an in-situ concrete layer at least in the connecting region between the at least one supporting beam and the component part, semi-finished part or finished part.

* * * * *